United States Patent [19]

Makowicki

[11] 4,089,467

[45] May 16, 1978

[54] POLYSTYRENE CONTAINER WITH POLYPROPYLENE HINGE AND LATCH

[75] Inventor: James M. Makowicki, Sandy Hook, Conn.

[73] Assignee: Curtiscorp, Inc., Sandy Hook, Conn.

[21] Appl. No.: 822,416

[22] Filed: Aug. 8, 1977

[51] Int. Cl.[2] ..... B65D 43/14; B65D 51/04

[52] U.S. Cl. ..... 220/334; 220/315; 220/DIG. 14; 16/128 R; 16/171

[58] Field of Search ..... 220/315, 334, 337, 339, 220/DIG. 13, DIG. 14; 16/128 R, 171; 150/.5; 229/2.5, 44 R

[56] References Cited

U.S. PATENT DOCUMENTS

| | | | |
|---|---|---|---|
| 3,592,354 | 7/1971 | Nielsen | 220/334 |
| 3,805,327 | 4/1974 | Walker | 16/171 X |

*Primary Examiner*—George T. Hall

*Attorney, Agent, or Firm*—Wooster, Davis & Cifelli

[57] ABSTRACT

A polystyrene box comprising a cover and a container section and having a pair of polypropylene hinges and a polypropylene latch. The container section has a sidewall having a pair of hinge slots disposed therein, and the cover has a corresponding pair of hinge slots adjacently disposed thereto. Each hinge comprises a flexible top having a pair of legs and is disposed so that one leg fits into a cover hinge slot while the other leg fits into the corresponding container section hinge slot. Each leg has a protruding blade on its end opposite the top of the hinge and each blade has an outwardly extending flange which digs into the side of the slot when the hinge is fully inserted thereby securing the hinge to the box. The latch is comprised of a cover portion and a container portion each of which is separately connected to their respective parts of the box in the same manner as the hinges. The container portion of the latch has a front leg with a knob which is disposed outside the container section. The cover portion has a front leg having a hole, and when the cover is closed, the knob of the container portion of the latch fits through the hole of the cover portion thereby fastening the cover.

16 Claims, 5 Drawing Figures

POLYSTYRENE CONTAINER WITH POLYPROPYLENE HINGE AND LATCH

BACKGROUND OF THE INVENTION

This invention relates to an improvement in plastic containers of a type which are commonly used for packing and shipping products. These containers are well-known and are very useful as they provide lightweight but effective protection.

There are several types of plastic containers in the prior art. Molded polystyrene foam boxes are often used, as are containers made from polystyrene beads which are expanded and heated and then molded to the desired shape. Accordingly, a product can be protected by molding one of these polystyrene containers to the exact form of the item. Because of the light weight of the polystyrene, the container can be made in sufficient thickness to protect the encased product from any damage without appreciably adding to the shipping weight. Consequently, these types of plastic containers are widely used today.

Despite their usefulness, however, the prior art polystyrene boxes have a substantial drawback. The molded polystyrene tends to be very soft and incapable of supporting conventional hinges, latches or the like which require screws, nails or other similar fasteners to secure them to the container itself. The plastic simply breaks away under these fasteners and will not hold them. As a result, the top and bottom of these containers are not attached, and have to be held together by other means such as tape. The tape is not reusable and often damages the boxes when it is removed. Nevertheless, despite these drawbacks, polystyrene or plastic containers are well-known and widely used today.

SUMMARY OF THE INVENTION

The polystyrene box according to the invention herein has a pair of single-piece hinges and a two-piece locking latch all of which can be easily inserted in and secured to the polystyrene box.

The box comprises a cover and a container section. The container section is comprised of a base having a peripherally disposed sidewall. The sidewall is of substantial thickness. When closed, the cover rests upon and is supported by the top of the sidewall. A pair of slots are disposed in one portion of the container section sidewall and extend from the top of the sidewall to near the base. A corresponding pair of slots is disposed in the cover, and when the cover is closed the container section slots are positioned directly below the cover slots.

A flexible, polypropylene hinge having a top and two legs extending downwardly therefrom, is positioned so that one of its legs fits into a slot of the cover, while the opposite leg fits into the corresponding slot of the container section. A channel is centrally disposed across the underside of the top of the hinge and this channel permits the hinge to fold back so that a hinge type action is created. The hinge is held in place by a pair of protruding blades having outwardly disposed flanges. Each blade is disposed on the end of a leg so that they bend inwardly when the legs of the hinge are being inserted into the respective slots. Once inserted, the blades flex outwardly against the side of the slot and their flanges dig into the plastic material of the box. Attempted removal of the hinge only results in the flanges digging further into the sides. Each hinge is configured in the same manner.

The sidewall of the container section opposite the hinges has a container section latch slot which extends downwardly from the top of the sidewall to near the base. A similar cover latch slot is disposed in the cover so that the respective latch slots are vertically aligned with each other when the cover is closed. The latch comprises two elements which are a cover portion and a container portion. The cover portion has a top having a rear leg configured like the legs of the hinge. This rear leg is adapted to be received by the cover latch slot and hold the cover portion of the latch in place. The cover portion of the latch also has a front leg having a hole disposed therein. When the latch is in place and the cover is closed, the front leg extends downwardly in front of the sidewall of the container portion.

The container portion of the latch has a top and a rear leg which is configured like the rear leg of the cover portion of the latch. The rear leg of the container portion is adapted to be received by the container latch slot and thereby hold this portion of the latch in place. The container portion also has a front leg extending downwardly from its top. The front leg of the container portion has a knob disposed thereon. When the container portion of the latch is in place, its front leg extends downwardly in front of the sidewall of the container section. The latch is thereby secured by inserting the knob of the front leg of the container portion into the hole of the front leg of the cover portion. The box is opened by bending the front leg of the cover portion of the latch away from the sidewall so that the knob is no longer positioned in the hole. The cover can then be opened and swung back on its hinges which keep the cover connected to the container section for future use.

Accordingly, a principal object of the present invention is to porvide a hinge which can be used with a polystyrene box.

Another object of the present invention is to provide a latch which can be used with a polystyrene box.

Another object of the present invention is to provide a plastic box which is easily reusable.

Other and more specific objects of the invention will be in part obvious and will in part appear from the following description of the preferred embodiments and the claims taken together with the drawings.

DRAWINGS

The same reference numbers refer to the same elements throughout the various figures.

DESCRIPTION OF THE PREFEERED EMBODIMENTS

Figure 1:
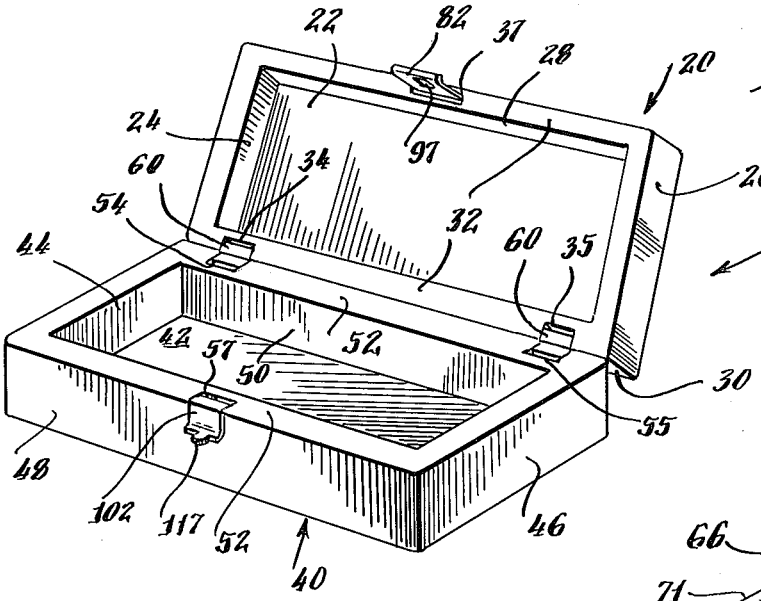
FIG. 1 is a perspective view of the box including two hinges and a latch according to the invention herein.

Referring now to FIG. 1, the polystyrene foam box according to the invention herein is shown at 10. The box 10 generally comprises two main elements which are a cover 20 and a container section 40.

As shown in FIG. 1, the cover 20 is generally comprised of a rectangular top 22 having a left sidewall 24, a right sidewall 26, a front sidewall 28 and a rear sidewall 30. All of the sidewalls 24, 26, 28, 30 are peripherally disposed on the top 22 and extend perpendicularly therefrom. The sidewalls 24, 26, 28, 30 are integral with each other and are all of the same height, as shown in FIG. 1. As the sidewalls are of considerable thickness, they form a continuous cover edge 32 opposite the top 22.

Figure 3:
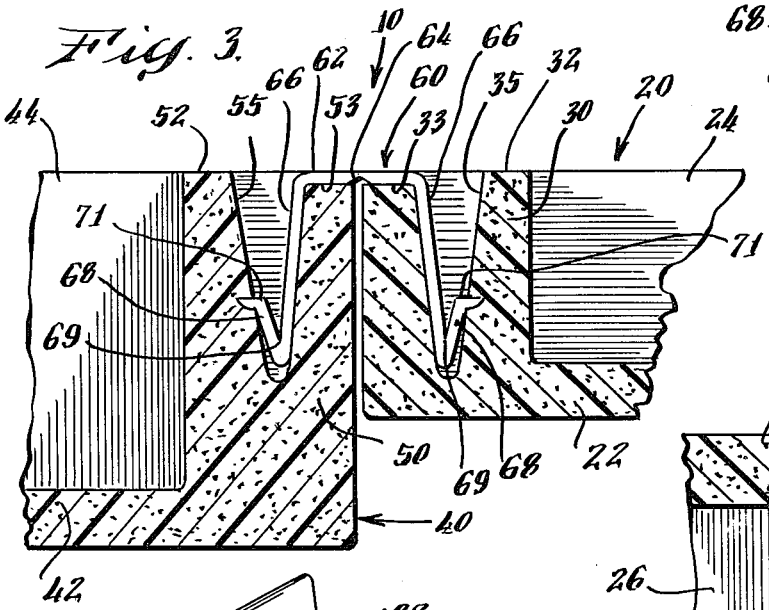
FIG. 3 is an enlarged cross-sectional view of the hinge of FIG. 2 in place in the box.

A left hinge slot 34 and a right hinge slot 35 are disposed in the rear sidewall 30. The slots 34, 35 are longitudinally aligned and spaced apart so that the left hinge slot 34 is located near the left sidewall 24, and the right hinge slot 35 is located near the right sidewall 26. The slots 34, 35 extend vertically from the cover edge 32 through the rear sidewall 30. As best shown in FIG. 3, the right hinge slot 35 is generally "V" shaped having its widest point at the cover edge 32 and reaching an apex adjacent to the top 22 of the cover 20. The left hinge slot 34 is identically configured.

Figure 5:
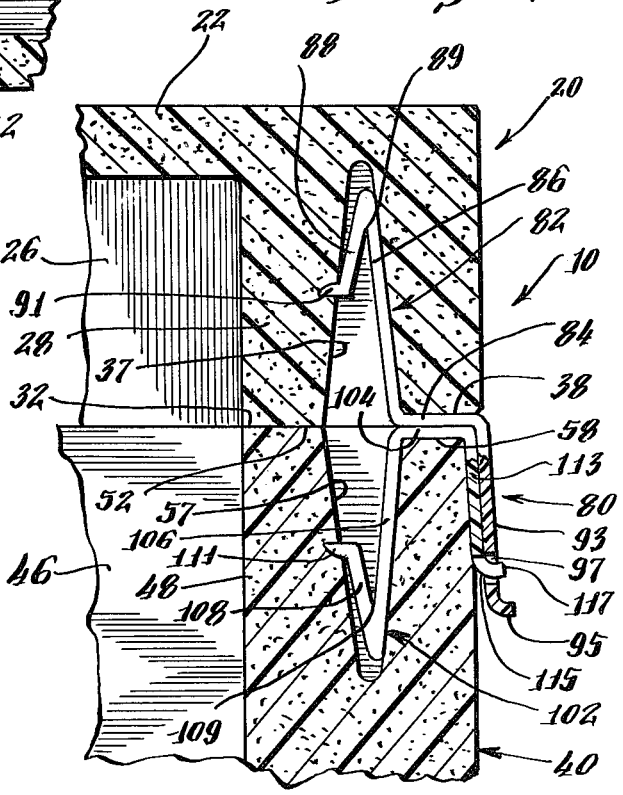
FIG. 5 is an enlarged cross-sectional view of the latch of FIG. 4 in place in the box.

A cover latch slot 37 is centrally disposed in the front sidewall 28 of the cover 20. The cover latch slot 37 extends vertically from the cover edge 32 through the front sidewall 28. As best shown in FIG. 5, it is substantially "V" shaped being widest at the cover edge 32 and reaching an apex adjacent to the top 22 of the cover 20.

As shown in FIG. 1, the container section 40 of the box 10 is generally comprised of a rectangular base 42 which is of the same dimensions as the rectangular top 22 of the cover 20. The base 42 has a left sidewall 44, a right sidewall 46, a front sidewall 48 and a rear sidewall 50. All the sidewalls are integral and peripherally disposed on the base 42 extending perpendicularly upward therefrom. The sidewalls of the container section 40 are of the same height and have a thickness which is approximately equal to the thickness of the sidewalls of the cover 20. The sidewalls 44, 46, 48, 50 of the container section 40 form a continuous edge 52, and when the cover 20 is closed over the container section 40, the container edge 52 contacts the cover edge 32.

A left hinge slot 54 and a right hinge slot 55 are disposed in the rear sidewall 50 of the container section 40. When the cover 20 is open, as shown in FIG. 3, the right hinge slot 55 of the container section 40 is disposed adjacent to the right hinge slot 35 of the cover 20, and similarly, the left hinge slot 54 of the container section 40 is disposed adjacent to the left hinge slot 34 of the cover 20. The right hinge slot 55 of the container section 40 and the right hinge slot 35 of the cover 20 are identically configured. The right hinge slot 55 is "V" shaped and extends from the container edge 52 downward into the rear sidewall 50. The widest part of the right hinge slot 55 is at the container edge 52 and its apex is nearest the base 42. The left hinge slot 54 is identical to the right hinge slot 55. When the cover 20 is closed, the right hinge slot 55 and the right hinge slot 35 of the cover 20 are vertically aligned, and the left hinge slot 54 and the left hinge slot 34 of the cover 20 are also vertically aligned. As shown in FIG. 1, a container section latch slot 57 is centrally located in the front sidewall 48. When the cover 20 is closed, the container section latch slot 57 is positioned directly below and vertically aligned with the cover latch slot 37, as shown in FIG. 5. The container section latch slot 57 is "V" shaped and extends from the container edge 52 towards the base 42. The container section latch slot 57 has its widest opening at the container edge 52 and its apex nearest the base 42.

Figure 2:
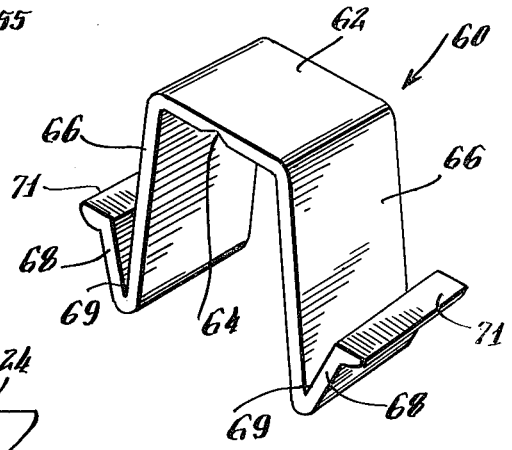
FIG. 2 is an enlarged perspective view of one of the hinges of FIG. 1.

A polypropylene hinge 60 is shown in FIG. 2. The hinge 60 generally comprises a substantially rectangular top 62 having a pair of legs 66 disposed on opposite sides and extending downwardly therefrom. Each leg 66 has a protruding blade 68 extending upward and outward from its end opposite the top 62. Each blade 68 forms a V bend 69 with its respective leg 66. The end of each blade 68 opposite the leg 66 has an outwardly extending flange 71 which is parallel to the top 62 of the hinge 60. A "V" channel 64 is centrally disposed on and laterally extends across the underside of the top 62. The hinge 60 can be folded along the channel 64 resulting in a hinge action movement of the top 62 and legs 66. The entire hinge 60 is made of a single piece of polypropylene and is somewhat flexible particularly along the channel 64 and V bends 69.

The hinge 60 is shown in place in the box 10 in FIG. 3. One of the legs 66 of the hinge 60 is inserted into the right hinge slot 35 of the cover 20, while the other leg 66 is inserted into the right hinge slot 55 of the container section 40. As the legs 66 extend outwardly from the top 62 of the hinge 60, they fit along the sides of these "V" shaped slots 35, 55, as shown in FIG. 3. As the hinge 60 is being inserted into the slots 35, 55, the V bends 69 permit the protruding blades 68 and their flanges 71 to flex towards the legs 66. As long as the hinge 60 is in the process of being inserted, each blade 68 and flange 71 simply slides along the side of the slot towards its apex. Once the hinge 60 has been completely inserted, however, the V bends 69 allow the protruding blades 68 and the flanges 71 to reflex or expand away from the legs 66. As a result, the flanges 71 dig into the sidewalls 30, 50, as shown in FIG. 3, thereby securing the hinge 60 in place. If removal of the hinge 60 is attempted, the flanges 71 will dig further into the sidewalls 30, 50 and increasing resist removal.

As shown in FIG. 3, when the hinge 60 is in place, the top 62 is disposed above that portion of the cover edge 32 and that portion of the container edge 52 which is located between their respective slots 35, 55. A small cut 33 is made in this portion of the rear sidewall 30 of the cover 20 and a similar cut 53 is made in the opposite portion of the container's rear sidewall 50 to accommodate the top of the hinge 60 and allow it to lie flush with the remainder of the sidewalls. This permits the cover edge 32 and container edge 52 to have complete contact with each other along the respective rear sidewalls 30, 50 when the cover 20 is closed. The channel 64 is positioned at the interface between the cover 20 and the container section 40. Consequently, as the hinge 60 can fold along the channel 64, the cover 20 can be closed over the container section 40 as the top 62 of the hinge 60 actually bends back upon itself along the channel 64. An identical hinge 60 is supplied for the left hinge slot 34 of the cover 20 and the left hinge slot 54 of the container section 40. It is held in place and operates in the same manner.

Figure 4:
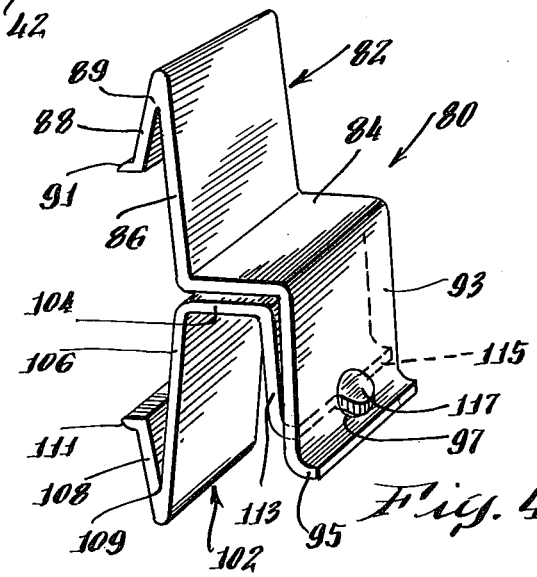
FIG. 4 is an enlarged perspective view of the latch of FIG. 1.

A latch 80 for the box is generally shown in FIG. 4. The latch 80 generally comprises two separate elements which are a cover portion 82 and a container portion 102. The cover portion 82 is made of a single piece of polypropylene having a rectangular top 84. A rear leg 86 extends upwardly from one of the longitudinal sides of the rectangular top 84. As shown in FIG. 4, the rear leg 86 has a protruding blade 88 disposed on its end opposite the rectangular top 84. The blade 88 extends away from and forms a V bend 89 with rear leg 86. The blade 88 has a flange 91 which is disposed on the end of the blade 88 opposite the leg 86. The flange 91 extends outwardly therefrom and is parallel to the top 84.

The cover portion 82 of the latch 80 also has a front leg 93. The front leg is disposed along the longitudinal side of the rectangular top 84 opposite the rear leg 86. The front leg 93 extends downwardly from the rectangular top 84 in a direction opposite that of the rear leg 86. As shown in FIG. 4, the front leg 93 has a curved end 95 opposite the top 84, and a hole 97 is centrally disposed in the front leg 93 near the curved end 95.

As shown in FIG. 4, the container portion 102 of the latch 80 is also made of a single piece of polyproplyene and is comprised of a top 104 which is rectangular and has substantially the same length and a slightly smaller width than the rectangular top 84 of the cover portion 82. The container portion 102 has a rear leg 106 which extends downwardly from one of the longitudinal sides of the top 104. The rear leg 106 has the protruding blade 108 extending upwardly from its end opposite the top 104. The blade 108 and the rear leg 106 form a V bend 109, as a shown in FIG. 4, and the blade 108 has a flange 111 on its end opposite the rear leg 106 and extending outwardly therefrom. The flange 111 is parallel to the top 104.

The container portion 102 of the latch 80 also has a front leg 113 which extends downwardly from the longitudinal side of the top 104 opposite the rear leg 106 in the same direction as the rear leg 106. The front leg 113 has a curved end 115 having a knob 117 centrally disposed thereon. The front leg 113 of the container portion 102 is shorter in length than the front leg 93 of the cover portion 82 of the latch 80.

The latch 80 is attached to the box 10 by inserting the rear leg 106 of the container portion 102 into the container latch slot 57. The V bend 109 permits the blade 108 and flange 111 to flex inwardly toward the rear leg 106 as the container portion 102 is being inserted. Once in place, however, the blade 108 and flange 111 reflex outwardly to their original position, and the flange 111 digs into the front sidewall 48, as shown in FIG. 5. When the container portion 102 of the latch 80 is in place, the front leg 113 extends down the outside of the front sidewall 48.

The rear leg 86 of the cover portion 82 of the latch 80 is inserted into the cover latch slot 37 in the same manner and is held in place when the flange 91 digs into the sidewall 28. The front leg 93 of the cover portion 82 of the latch 80 extends downwardly from the cover 20, as shown in FIG. 5, when the cover 20 is closed, the front leg 93 of the cover portion 82 and the front leg 113 of the container portion 102 of the latch 80 are juxtaposed so that the knob 117 of the container portion 102 is positioned directly behind the hole 97 of the cover portion 82. When the knob 117 is inserted into the hole 97, the cover 20 is thereby secured to the container section 40 of the box 10. To release the cover 20, the curved end 95 of the front leg 93 of the cover portion 82 is bent slightly away from the front leg 113 of the container portion 102 so that the knob 117 is no longer in the hole 97. The cover 20 can then be opened and swung back by operation of the hinges 60. The box 10 can, therefore, be opened, closed, and resealed as desired without the need for tape, wire, or the like.

As shown in FIG. 5, a small cut 38 is located in the portion of the front sidewall 28 of the cover 20 between the cover latch slot 37 and the outside of the box and a similar cut 58 is made in the corresponding portion of the container section's front sidewall 48. These cuts 37, 57 accommodate the tops 84, 104 of the respective latch sections 82, 102 and permit the cover 20 to lie flush against the container section 40 when the cover 20 is closed.

It should be noted that this invention is also useful in regard to boxes or containers made of molded polystyrene beads rather than merely a polystyrene foam, and other similar substances can be used to construct the box. Although polypropylene can be used for the hinges and the latch, other substances can be used in their fabrication. Further, it is also possible to use only one hinge or more than two. The hinges may be positioned with respect to the cover other than as described in the preferred embodiment although the described positioning results in substantially all of the hinge being hidden when the box is closed.

From the foregoing description of the invention and the discussion of the prior art, the numerous advantages and improvements incident to this invention will now be apparent to those skilled in the art.

Accordingly, the above description of the invention is to be construed as illustrative only rather than limiting. The invention is limited only by the scope of the following claims.

I claim:

1. A box comprising a container section and a cover, said container section having at least one hinge slot disposed therein, and said cover also having a hinge slot corresponding to each of said container section hinge slots and being positioned adjacent thereto when said cover is in place, and at least one hinge having a flexible top, said top having a pair of legs extending downwardly therefrom, each of said legs having an upwardly extending, protruding blade disposed thereon, one of said legs being disposed in one of said container section hinge slots and the other of said legs being disposed in said corresponding hinge slot of said cover, said hinge being held in place by the interaction of said blades against the sides of said respective hinge slots.

2. A box as defined in claim 1 wherein each of said protruding blades forms a V bend with its respective leg, said bend being disposed on the end of said opposite said top, said bend permitting said blade to flex inwardly toward said leg as said leg is inserted into said hinge slot, and to reflex outwardly against the side of said slot once said leg is completely inserted.

3. A box as defined in claim 2 wherein each of said protruding blades has a flange extending outwardly therefrom,and when said leg of said hinge is in place in said hinge slot, said flange digs into the side of said slot securing said hinge in place.

4. A box as defined in claim 3 wherein said container section hinge slots and said cover hinge slots are "V" shaped.

5. A box as defined in claim 1 wherein said hinge top is substantially rectangular and said legs of said hinge are disposed on and extend downwardly from opposite edges of said top.

6. A box as defined in claim 5 wherein said hinge top has a channel centrally disposed across its underside parallel to said legs, said channel thereby permitting said hinge to bend in a hinge action.

7. A box as defined in claim 1 wherein each said hinge is integral and made of a single piece of polypropylene.

8. A box as defined in claim 1 wherein said cover has a cover latch slot disposed therein, and a latch comprising a cover portion and a container portion, said cover portion having a top, said top having a rear leg extending upwardly therefrom, said rear leg having a downwardly extending, protruding blade disposed thereon, said rear leg being disposed in said cover latch slot and being held in place by the interaction of said blade against the side of said cover latch slot, said top also having a front leg, said container portion of said latch being secured to said container section of said box, and when said cover is closed, said front leg of said cover portion being selectively engaged to said container portion of said latch thereby locking said box.

9. A box as defined in claim 8 wherein said protruding blade is disposed on the end of said rear leg of said cover portion opposite said top, said rear leg forming a V bend with said leg, said bend permitting said blade to flex inwardly toward said rear leg when said rear leg is inserted into said cover latch slot and to reflex outwardly against the side of said cover latch slot once said rear leg is completely inserted, said blade having an outwardly disposed flange on its end opposite said V bend, said flange digging into the side of said cover latch slot securing said cover portion of said latch in place.

10. A box as defined in claim 8 wherein said top of said cover portion of said latch is substantially rectangular and said front leg is disposed on an edge of said top opposite said rear leg, said front leg extending downwardly from said top and having a curved end opposite said top.

11. A box as defined in claim 10 wherein said container section having a container latch slot disposed directly below said cover latch slot when said cover is closed, said container portion of said latch having a top, said top having a rear leg extending downwardly therefrom, said rear leg of said container portion of said latch having an upwardly extending protruding blade disposed thereon, said rear leg being disposed in said container latch slot and being held in place by the interaction of said blade against the side of said container latch slot.

12. A box as defined in claim 11 wherein said protruding blade is disposed on the end of said rear leg of said container portion, said blade forming a V bend with said rear leg of said container portion, said bend permitting said blade to flex inwardly toward said rear leg when said rear leg is inserted into said container latch slot and to reflex outwardly against the side of said container latch slot once said rear leg is completely inserted, said blade having an outwardly disposed flange on its end opposite said V bend, said flange digging into the side of said container latch slot to hold said container portion of said latch in place.

13. A box defined in clain 12 wherein said front leg of said cover portion defines a hole centrally disposed therein near said curved end, said container portion of said latch also having a front leg extending downwardly therefrom, said front leg of said container portion having an outwardly extending knob, said knob fitting through said hole in said front leg of said cover portion when said cover is closed thereby locking said latch.

14. A box as defined in claim 8 wherein said cover portion of said latch is integral and made of a single piece of polypropylene and said container portion of said latch is also integral and made of a single piece of polypropylene.

15. A box as defined in claim 12 wherein said container section comprises a rectangular base having a left sidewall, a right sidewall, a front sidewall and a rear sidewall peripherally disposed thereon, said sidewalls being integral and forming a continuous container edge, said container section hinge slots being "V" shaped and disposed in said rear sidewall so that said slots are aligned with each other and extend from said container edge of said rear sidewall to an apex near said base, and said container latch slot being "V" shaped and centrally disposed in said front sidewall, said container latch slot extending from said container edge of said front sidewall to an apex near said base, and said cover comprises a rectangular top having a left sidewall, a right sidewall, a front sidewall and a rear sidewall peripherally disposed thereon, said sidewalls being integral and forming a continuous cover edge, said cover hinge slots being "V" shaped and disposed in said rear sidewall so that said slots are aligned with each other and extend from said cover edge of said rear sidewall to an apex near said top and said cover latch slot being "V" shaped and centrally disposed in said front sidewall, said cover latch slot extending from said cover edge of said front sidewall to and apex near said top.

16. A box as defined in claim 1 wherein said container section and said cover are made of polystyrene foam.

* * * * *